United States Patent [19]

Fukagawa

[11] Patent Number: 5,040,959

[45] Date of Patent: Aug. 20, 1991

[54] ROOTS BLOWER WITH IMPROVED CLEARANCE BETWEEN ROTORS

[75] Inventor: Tetsuo Fukagawa, Tokyo, Japan

[73] Assignee: Fuji Jukogyo Kabushiki Kaisha, Tokyo, Japan

[21] Appl. No.: 476,313

[22] Filed: Feb. 7, 1990

[30] Foreign Application Priority Data

Feb. 17, 1989 [JP] Japan ..... 1-38814

[51] Int. Cl.[5] ..... F04C 18/18

[52] U.S. Cl. ..... 418/150; 418/206

[58] Field of Search ..... 418/150, 206

[56] References Cited

U.S. PATENT DOCUMENTS 3,275,225 9/1966 Schultz ..... 418/150

4,666,384 5/1987 Kaga et al. ..... 418/150

FOREIGN PATENT DOCUMENTS 60-75793 4/1985 Japan ..... 418/150

*Primary Examiner*—John J. Vrablik

*Attorney, Agent, or Firm*—Beveridge, DeGrandi & Weilacher

[57] ABSTRACT

A Roots blower has two rotors in which each of said rotors, as viewed in plan view thereof in the direction of the rotational axis thereof. The rotor has a center and orthogonal short and long axes and has a final shape of a contour offset from a basic profile curve by an offset distance at every point thereof in the normal line direction thereto. The offset distance is also determined in accordance with a function which assumes a maximum value when the angle between a line connecting the rotor center with the point and either of the short and long axes is 45 degrees, which assumes a minimum value when the line coincides with either of the short and long axes, and the function comprises an exponential power of a sine function.

2 Claims, 4 Drawing Sheets

α = 45°

α = 0°

ROOTS BLOWER WITH IMPROVED CLEARANCE BETWEEN ROTORS

BACKGROUND OF THE INVENTION

The present invention relates to a Roots blower with improved clearance between its rotors and improved volumetric efficiency.

As is known, Roots type blowers are of simple construction and are relatively trouble free. For these reasons, Roots blowers are widely used, such as a supercharger of an internal-combustion engine in which secondary pressure is relatively low or an air blower for various industrial equipments. For these blowers, various shapes or profiles of their blowers are used, for example, a cycloidal shape, an involute shape or an envelope shape.

A typical known Roots blower is of the straight two-lobe rotary type. Its housing has a suction port at its inlet side and a delivery port at its outlet side. Between the suction and delivery ports is communicatively interposed a rotor chamber. There is a 90-degree phase difference between the two rotors in the rotor chamber. The rotors are fixedly supported respectively on parallel rotor shafts. The rotor shafts lie in a plane perpendicular to a line including the centers of the suction and delivery ports. The ends of these rotor shafts are rotatably supported by a wall of the housing between the rotor chamber and a gear chamber in the housing.

The other ends of the rotor shafts rotatably supported by the wall extend into the gear chamber through the wall. The shaft ends fixedly support two gears in the gear chamber, respectively, which are meshed with each other.

Thus, the rotor shafts and their rotor synchronously engages and rotates in an opposite direction at the same speed. As a result, a fluid such as air flows from the suction port to the delivery port.

As the fluid is air in the case where this type of Roots blower is used for a compressor of an internal combustion engine, the two rotors must be rotated without lubricating oil. Furthermore, mechanical interference may occur between various parts because of high rotational speed. For example, interference may occasionally occur between the two rotors. Another possibility is the interference between the two rotors and the wall. Therefore, an appropriate clearance must be provided therebetween in order to avoid such interference.

However, if the clearance is large, the air being pumped leaks from the clearance during the rotation of the rotors. Consequently there arises the problem of a drop in the volumetric efficiency of the blower.

Accordingly, it is necessary to prevent the volumetric efficiency from dropping. For this purpose, it is necessary to reduce the clearances by considering the following factors.

1. Backlash of the two gears for synchronizing the phase of the rotor.
2. Assembly error for synchronizing the phase of the two rotors.
3. Fabrication error of the distance between centers of the two rotors.
4. Fabrication error of the profile of the rotor.
5. Thermal expansion of the rotor due to heat of compressed air by the rotation of the rotors.

The clearance therefore must be as small as possible by considering the factors written above, and thus it is required to prevent volumetric efficiency from decreasing. Most important factor of the above is the phase error between the two rotors. As for the other factors, it is possible to reduce the clearances by improving the fabrication precision.

The clearance between the rotors is provided for prevention of interference therebetween. The clearance is generally formed by providing a specific relief or an offset with respect to the profile of the rotor. That is, the relief or the offset quantity is provided with a combination of epicycloidal and hypocycloidal curves of the rotor profile defined.

A technique for reducing the clearance between the rotors to a minimum is disclosed in Japanese Patent Laid-Open Publn. No. 75793/1985. According to this prior art, a secondary relief quantity or the offset quantity of the rotor basic profile is determined by an angle between a normal line at a point on an outer periphery of the rotor basic profile and a line connecting the two rotor centers.

More specifically, a curve is obtained by relieving a minimum clearance (i.e. a primary relief quantity) necessary for permitting rotation of the rotor without contacting each other from the original profile curve of the rotor. That is, the basic curve is obtained by reducing a specific quantity in the normal direction from the profile curve of the rotor. Then, secondary relief quantity is determined with a function of increasing or decreasing the profile in correspondence with the above mentioned angle with respect to the basic curve. Then, a fabrication or assembly error is added to the above mentioned primary relief quantity. In this manner, the profile of each rotor is finished.

However, in the above described prior art, it has been necessary to determine the finally finished profile by adding the secondary relief quantity or offset to the primary ones. For this reason, the method is indirect, and errors are easily increased during fabrication of the rotors. Thus, there has been a limit inherently to the reduction of the clearance between the rotors while interference of the rotors is being prevented.

Therefore, there has remained the problem of attaining a large improvement in the volumetric efficiency of the Roots blower. For this purpose, setting of the clearance between the rotors must be made even more accurate. In order to achieve this accuracy, high-precision fabrication of the rotors is imperative.

SUMMARY OF THE INVENTION

In view of the above described circumstances of the prior art, it is a general object of the present invention to provide a Roots blower in which an optimum rotor profile is obtained with high precision, and moreover the two contradictory requirements of prevention of interference of the rotors and reduction of the clearance therebetween are both satisfied with good compatibility, whereby the volumetric efficiency of the blower is largely improved.

According to the present invention, there is provided a Roots blower having two rotors in which each of the rotors, as viewed in plan view thereof in the rotational direction of the axis thereof, has a center orthogonal short and long axes and a finished profile of a contour offset from a basic profile curve having an offset distance in the normal line direction. This offset distance is determined in accordance with a function which assumes a maximum value when the angle formed by a line connecting the rotor center with a point on the profile curve and either of the rotor short or long axis is within a specific angle, and which assumes a minimum value when the line coincides with either of the rotor short or long axis.

It is desirable that the above specific angle at which the function assumes a maximum value be 45 degrees. It is also desirable that the function comprises an exponential power of a sine function.

More specifically, the offset in the normal line direction at the point on the basic profile curve of the rotor is determined in accordance with the above mentioned function. This offset becomes maximum when the angle between the line connecting the point on the profile curve with the rotor center and either of the short and long axis of the rotor is a specific angle. The offset becomes minimum when the line coincides with either of the short or long axis.

A preferred embodiment of the present invention will become understood from the following detailed description referring to the accompanying drawings.

DETAILED DESCRIPTION OF THE PREFERRED EMBODIMENT

With reference to the accompanying drawings, a preferred embodiment of the present invention will be described in more detail hereinafter.

Figure 8:
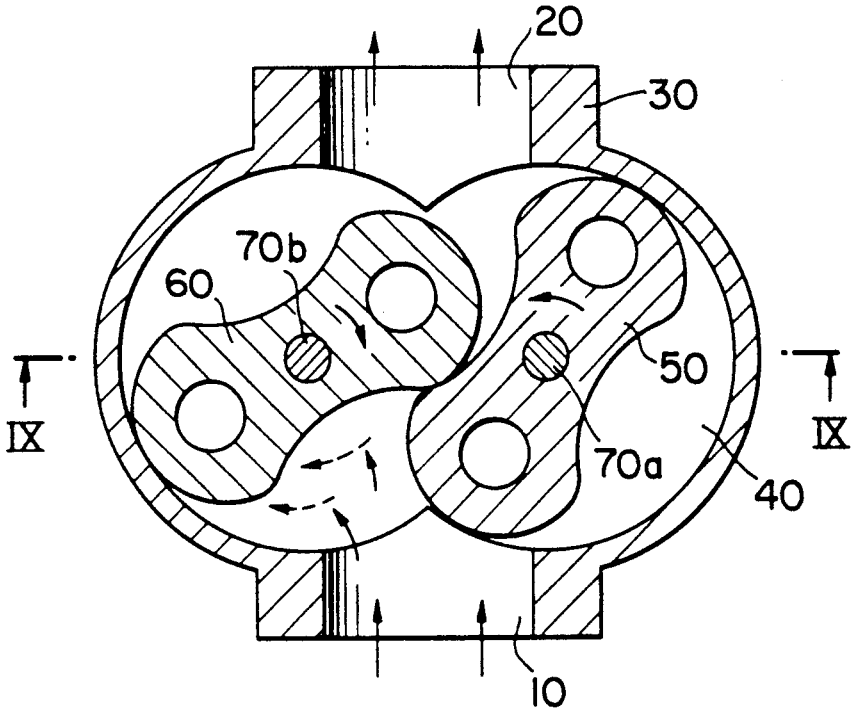
FIG. 8 is a rotor-axial view of Roots blower.
Figure 9:
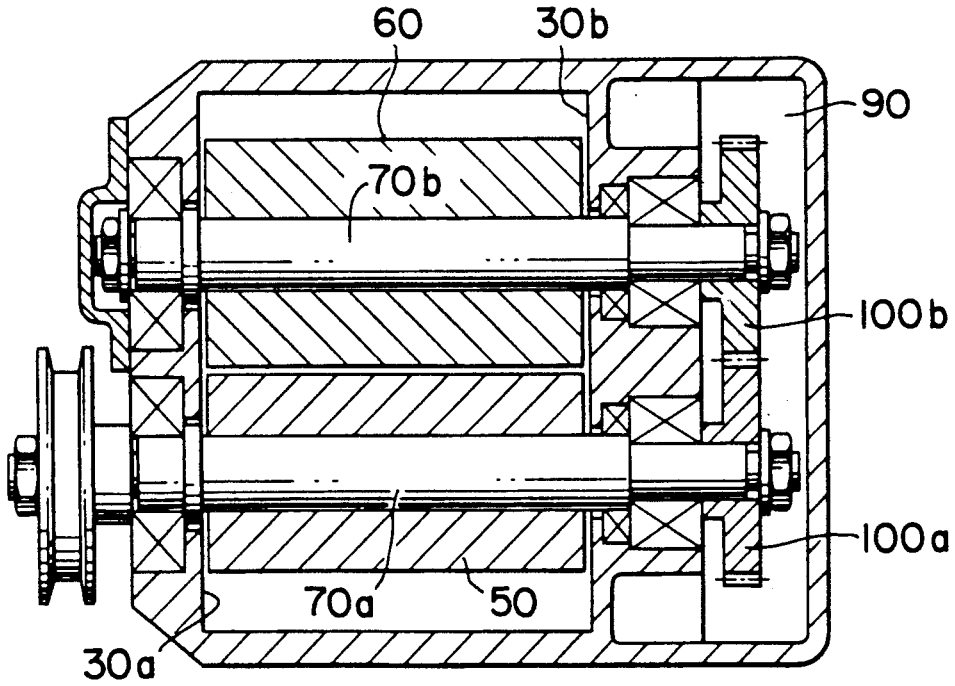
FIG. 9 is a section taken along the plane indicated by line IX—IX in FIG. 8 as viewed in the arrow direction.

A known Roots blower is of the straight two lobe rotary type (see FIGS. 8 and 9). The blower has a rotor housing 30 provided at an inlet side with a suction port 10 and at an opposite outlet side with a delivery port 20. The rotor housing 30 forms a rotor chamber 40 and a gear chamber 90 interposed between the suction and delivery ports 10 and 20. Rotors 50 and 60 with mutually 90-degree phase difference are installed within the rotor chamber 40. The rotors 50 and 60 are fixed on parallel rotor shafts 70*a* and 70*b*, respectively. The rotor shafts 70*a* and 70*b* lie in a single plane perpendicular to a line connecting centers of the suction and delivery ports 10 and 20. Ends of the rotor shafts 70*a* and 70*b* are rotatably supported by a wall 30*a* of the housing 30 and a partition 30*b* between the rotor chamber 40 and the gear chamber 90.

The ends of the rotor shafts 70*a* and 70*b* extend through the partition 30*b* and into the gear chamber 90. Within the gear chamber 90, gears 100*a* and 100*b* are fixed on the shaft ends respectively, which are meshed with each other.

Thus, the rotor shafts 70*a* and 70*b*, and the rotors 50 and 60, are synchronously engaged and are rotatable in mutually opposite directions at the same rotational speed. As a result, fluid such as air is pumped from the suction port 10 and discharged through the delivery port 20.

Figure 1:
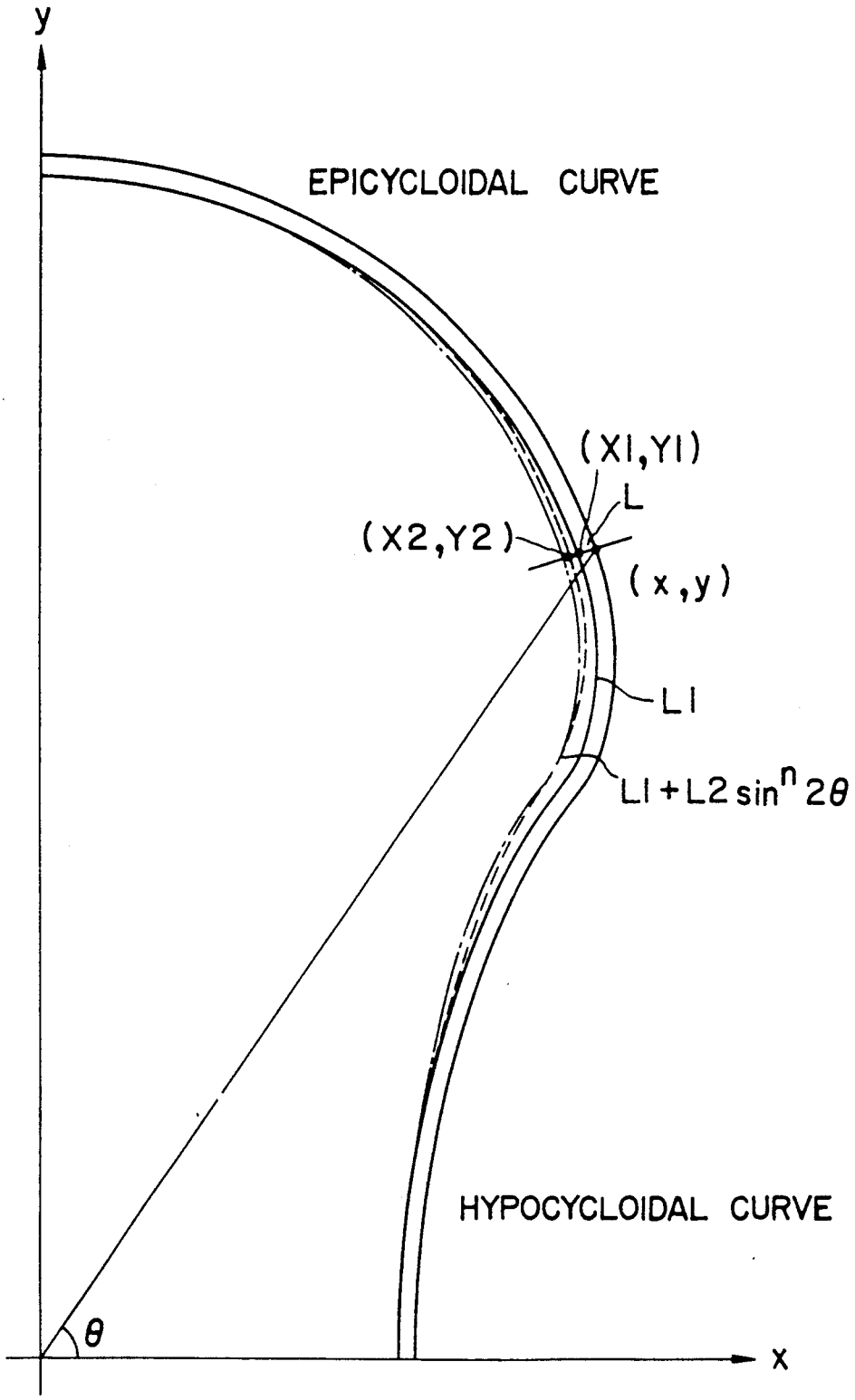
FIG. 1 is a plan view in axis of a Roots blower rotor in a rotational direction according to the present invention.

A preferred embodiment of the present invention will now be described with reference to FIGS. 1 through 7. In FIG. 1 showing one half of rotor lobe according to the present invention, a solid line of a peripheral curve defines a basic profile curve of a rotor 1 according to the present invention. The profile curve is cycloidal. For the following analytical description, a short centerline of each rotor 1 coincides with an axis x of coordinate axes x and y, while a long centerline coincides with the axis y. A point on the profile curve at which it is intersected by a line at an angle $\theta=45°$ of rolling, a circle is a boundary. With respect to the boundary, the profile curve on the short centerline side is a hypocycloidal curve, while the curve on the long centerline side is epicycloidal. In order to prevent interference of the two rotors 1, 1, it is necessary to secure a clearance therebetween by providing a specific relief quantity (hereinafter referred to as offset) L.

Figure 2:
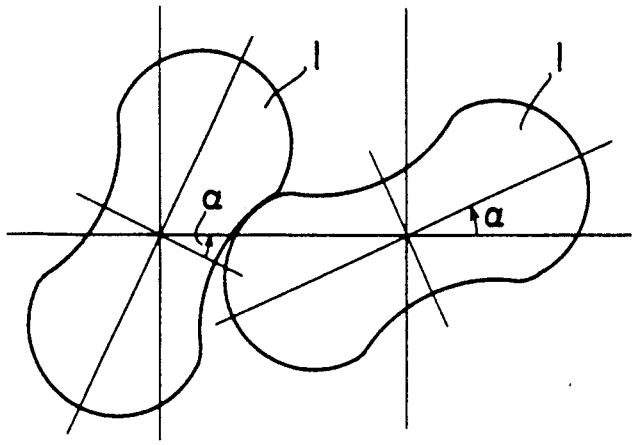
FIG. 2 is a simplified plan view indicating a rotor rotational angle assumed by the two rotors of the blower.
Figure 3:
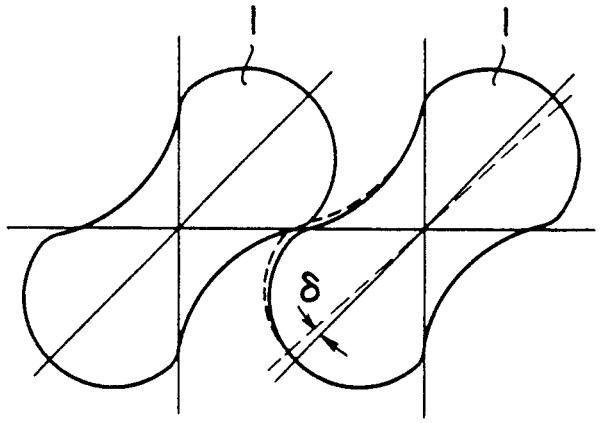
FIGS. 3 and 4 are similar plan views indicating phase errors or deviations.
Figure 4:
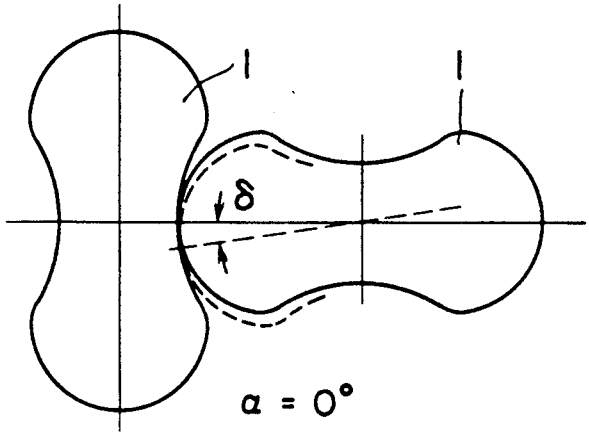
Figure 5:
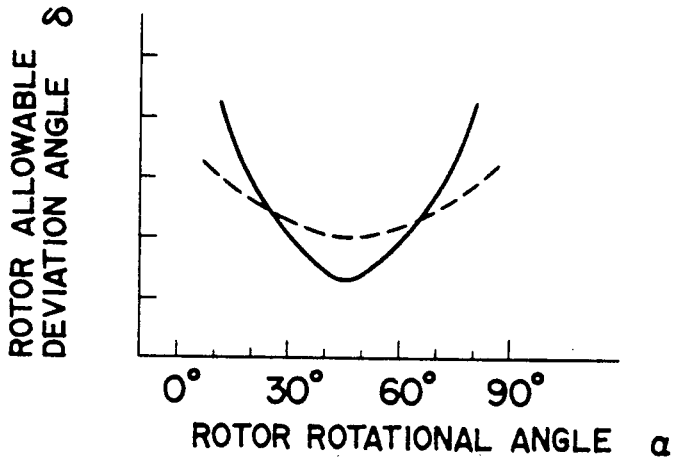
FIG. 5 is a graph indicating relationships between rotor rotational angle and allowable deviation angle of the rotor.

In this case, a rotational angle u of each rotor 1 can be assumed to be as indicated in FIG. 2. Then, as shown in FIGS. 3 and 4, an allowable deviation angle $\delta$ due to a phase error of the rotor 1 becomes maximum at the rotational angle $\alpha$ of 0 degrees for the same clearance between the rotors 1, 1. The allowable deviation angle $\delta$ takes a minimum value at the rotational angle $\alpha$ of 45 degrees.

According to the present invention, the determination of the offset L of the profile curve will now be described more specifically with respect to a two-lobe rotor of cycloidal shape as a representative example.

A cycloidal rotor 1 is formed in a curve formed by a combination of hypocycloidal curves and epicycloidal curves. Each hypocycloidal curve is defined by the following equations.

$$\left.\begin{aligned} x &= 0.75\, r\cos\theta - 0.25\, r\cos 3\theta \\ y &= 0.75\, r\sin\theta + 0.25\, r\sin 3\theta \end{aligned}\right\} \quad (1)$$

where: $0 \leqq \theta \leqq (\pi/4)$;

r is a radius of a pitch circle; and $\theta$ is an angle of a rolling (generating) circle. Each epicycloidal curve is furthermore defined by the following equations.

$$\left.\begin{aligned} x &= 1.25\, r\cos\theta + 0.25\, r\cos 5\theta \\ y &= 1.25\, r\sin\theta + 0.25\, r\sin 5\theta \end{aligned}\right\} \quad (2)$$

where: $(\pi/4) \leqq \theta \leqq (\pi/2)$

Thus, the basic profile curve of each rotor 1 comprises cycloidal curves defined respectively by Equations (1) and (2). The offset L from the profile curve is given, for example, as a curve which is offset by a specific quantity in a normal line direction at points (x, y) to the profile curve.

Point (X1, Y1) on the curve is given by the following equations $$\left.\begin{aligned} X1 &= x - L \sin \omega \\ Y1 &= y + L \cos \omega \end{aligned}\right\} \quad (3)$$

where: $\omega = \tan^{-1}(dy/dx)$, which represents a tangent angle at the coordinates (x, y).

When the rotor 1 is formed in accordance with the curve given by the above Equation (3), the clearance S between the rotors becomes two times the above mentioned offset L and takes a constant value $S = 2 \times L$ relative to the rotational angle $\alpha$. For example, in the case of L=0.05 mm, the clearance S between the rotors is indicated by line a in FIG. 6. In the case of L=0.08 mm, the clearance S is indicated by line b in FIG. 6.

However, the relationship between the rotor rotational angle u and the allowable deviation angle $\delta$ becomes such a relation that the deviation angle $\delta$ varies largely with the angle $\alpha$. This is indicated by a solid line in FIG. 5. For this reason, with consideration of the allowable deviation angle $\delta$, the offset L is set at the clearance $S_{min}$45 necessary for a rotational angle $\alpha = 45°$. Then, the allowable deviation angle $\delta$ is large at the rotational angle $\alpha = 0°$. Therefore the clearance S between the rotors becomes unnecessarily excessively large and is undesirable for maintaining a desirable volumetric efficiency.

On the other hand, if the above mentioned offset L is set at a clearance $S_{min}0$ necessary for a rotational angle $\alpha = 0°$, there arises another problems. That is, when the rotational angle $\alpha = 45°$, the allowable deviation angle $\delta$ is small. For this reason, the clearance S between the rotors is excessively small. Therefore there is the undesirable possibility of interference between the rotors.

Accordingly, desirable determination of the offset L on the profile curve of the rotor 1 is as follows. The offset L is determined as the clearance $S_{min}$45 necessary for a rotational angle $\alpha = 45°$ becomes maximum and as the clearance $S_{min}$0 necessary for a rotational angle $\alpha = 0°$ takes a minimum value.

For this purpose, the offset L is set by a function which varies in accordance with the rotor rotational angle $\alpha$. The function also assumes the maximum value for $\alpha = 45°$ and the minimum value for $\alpha = 0°$.

An example of this function can be expressed by the following expression in terms of the angle $\theta$ as a variable. The angle $\theta$ is the aforementioned angle $\theta$ of the rolling circle of the cycloidal curve of the rotor.

$$L = L1 + L2(\sin 2\theta)^n \quad (4)$$

where:

$$L1 = S_{min}0 \times \tfrac{1}{2}$$

$$L2 = (S_{min}45 - S_{min}0) \times \tfrac{1}{2}$$

In this Equation (4), the clearance $S_{min}0$ (the minimum clearance) for the rotor rotation angle $\alpha = 0°$, that is, for the rolling circle angle $\theta = 0°$ is obtained by means of the offset L1 ($= S_{min}0 \times \frac{1}{2}$). Furthermore, the difference between the clearances $S_{min}45$ and $S_{min}0$ is made twice the offset L2. That is, offset $L2 = (S_{min}45 - S_{min}0) \times \frac{1}{2}$. The clearance $S_{min}45$ is the offset for a rotational angle $\alpha = 45°$ (rolling circle angle $\theta = 45°$). The clearance $S_{min}0$ is that for a rotational angle $\alpha = 0°$ (rolling circle angle $\theta = 0°$). Then, the quantity to be added to the offset L1 is varied in correspondence with the rotational angle $\alpha$.

The offset L1 is a value which is mainly determined by accuracy of finishing procedure. The offset L2 is a value which is mainly determined by errors in the distance between the centers of the rotors, such as backlash of the gears (not shown).

Figure 7:
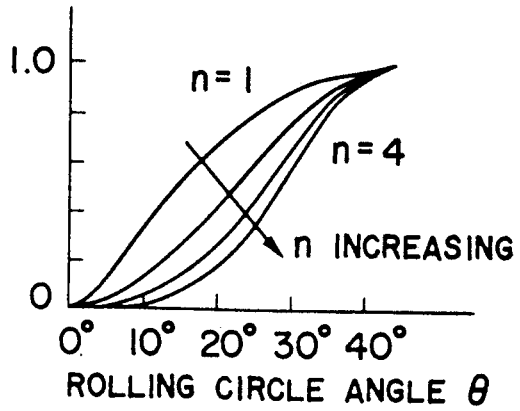
FIG. 7 is a graph relating to a function for calculating the shape of each rotor of the invention.

The value of the quantity $(\sin 2\theta)^n$ in the above Equation (4) varies in accordance with the order of the exponent n as indicated in FIG. 7. By appropriately selecting the value of the exponent n, the offset L can be suitably set. In general, with n substantially equal to 4, the rate of variation of the curve approaches saturation. In actual practice, therefore, by setting the exponent n at an order of up to the fourth power, the above Equation (4) is ample.

By modifying Equation (3) by using Equation (4), a curve for determining the final profile of the rotor 1 is obtained. A point X2, Y2 as shown in FIG. 1 on this curve is given by $$\left.\begin{aligned} X2 &= x - \{L1 + L2\ (\sin 2\theta)^n\} \sin \omega \\ Y2 &= y + \{L1 + L2\ (\sin 2\theta)^n\} \cos \omega \end{aligned}\right\} \quad (5)$$

For the final profile of the rotor 1 according to Equation (5), for example, L1=0.05 and L2=0.03 for the following conditions.

Pitch circle radius r=25 mm
Distance between rotor centers=50 mm
$S_{min}0$=0.1 mm
$S_{min}45$=0.16 mm
Exponent n=4

As a result, the final profile of the rotor 1 becomes a shape as indicated by a dotted line in FIG. 1 offset in accordance with Equation (4) from the profile curve indicated by the outer contour or profile curve shown in solid line. In the case of an exponent n=2, the final profile becomes as indicated by a single-dotted chain line in FIG. 1.

The solid line drawn inside the above mentioned profile curve indicates a shape offset by a constant offset value L1.

Figure 6:
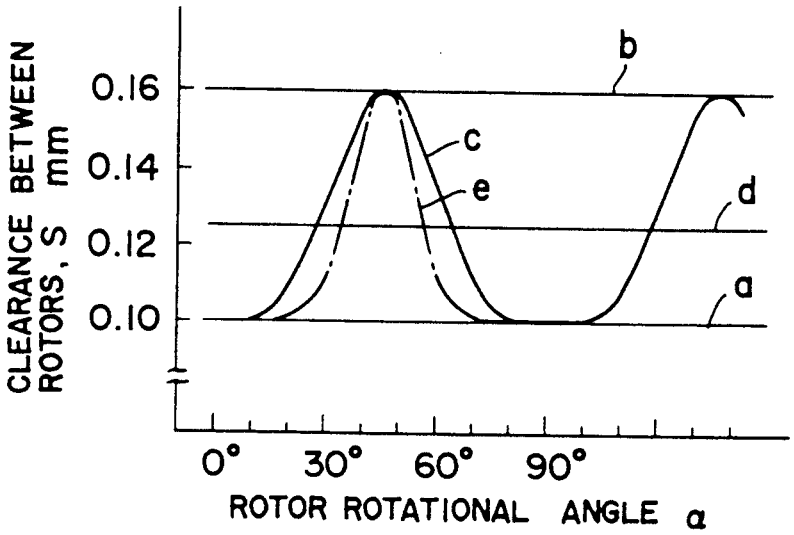
FIG. 6 is a graph indicating relationships between rotor rotational angle and clearance between rotors.

In this case, the clearance S between the rotors is indicated by the curve c in FIG. 6. When the rotational angle $\alpha = 45°$, the clearance assumes a maximum value $S_{max} = ((L1 + L2) \times 2)$. When the rotational angle $\alpha = 0°$, the clearance assumes a minimum value $S_{min} = (L1 \times 2)$. Furthermore, the trend of the allowable deviation angle $\delta$ with respect to the rotor rotational angle $\alpha$ becomes as indicated by the intermittent line curve in FIG. 5.

In the case where only the offset L1 of the first term of Equation (4) is substantially the offset L from the rotor profile curve within a specific range 0 to $\theta 1$ of the rotational angle $\alpha$ (for example, 0° to 15°), the offset L can be expressed by the following expression.

$$L = L1 + L2\left\{\sin \frac{(\pi/2)(\theta - \theta 1)}{([\pi/4] - \theta 1)}\right\}^n \quad (6)$$

where: $\theta - \theta 1 = 0$ when $(\theta - \theta 1) < 0$.

Then, Equation (5) becomes the following Equation (7). Thus, the range relative to the offset L2 can be set. An even more precise setting of the clearance between the rotors becomes possible as indicated by curve e in FIG. 6.

$$\left.\begin{aligned} X2 &= X - \left[ L1 + L2\left\{ \sin \frac{(\pi/2)(\theta - \theta 1)}{(\pi/4 - \theta 1)} \right\}^n \right] \sin \omega \\ Y2 &= Y - \left[ L1 + L2\left\{ \sin \frac{(\pi/2)(\theta - \theta 1)}{(\pi/4 - \theta 1)} \right\}^n \right] \cos \omega \end{aligned}\right\} \quad (7)$$

Therefore, the final finished profile of the rotor can be determined immediately from the original or basic profile curve. As mentioned hereinbefore, the original profile curve comprises a combination of the hypocycloidal curves and the epicycloidal curves. Thus, an optimum profile can be obtained with high precision.

That is, one characteristic of the optimum profile is that the clearance S between the rotors is maximum in terms of the rotor rotational angle $\alpha$ when the rotational angle $\alpha=45°$, at which the allowable deviation $\delta$ is a minimum. Conversely, another characteristic is that the clearance S is minimum when the rotational angle $\alpha=0°$, corresponding to the maximum value of the allowable deviation $\delta$. The resulting average clearance S is shown by a line d in FIG. 6 between the rotors. The clearance is much smaller than that in the prior art. Thus, the volumetric efficiency of the blower is remarkably improved.

In the foregoing disclosure, the Roots blower of the present invention is described with the specific example thereof provided with the two-lobe rotors with the cycloidal shape. The present invention is not so limited with the disclosure above. It is to be understood that the invention can be applied with equal effectiveness to the Roots blowers with the rotors each having three or more lobes and having profiles of other shapes.

As described above, the present invention is characterized by several novel and advantageous features. The most important features are as follows.

According to the present invention, the optimum rotor shape can be immediately obtained from the rotor profile curve with high precision. At the same time, an appreciable reduction in the clearance between the rotors can be attained with high precision.

Furthermore, the offset from the above mentioned rotor profile curve is determined in accordance with the function which assumes a maximum value at 45°. Besides, the maximum clearance between the rotors with a minimum allowable deviation value of the rotor can be made.

Still another feature is that, a fine adjustment of the offset can be accomplished by the order of the exponential power with the above mentioned function as an exponential power of a sine function.

That is, the conflicting requirements of prevention of mutual interference between the rotors and reduction of the clearance between the rotors are compatibly met in the Roots blower of the present invention. Thus, the volumetric efficiency of the blower is remarkably improved.

The present invention overcomes the problems and limitations discussed. More specifically, the present invention provides the Roots blower in which the optimum rotor profile is obtained with high precision. Moreover, prevention of interference of the rotors and reduction of the clearance therebetween are compatibly achieved. Thus, the volumetric efficiency of the Roots blower of the present invention is largely improved.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. A Roots blower having a plurality of rotors, each of said rotors having a center, an orthogonal short and a long axes and a contour shape offset from a basic profile curve, the improvement in said blower wherein:

said basic profile curve is a combination of epicycloidal curves and hypocycloidal curves, and said contour shape offset is defined by an equation:

$$L = L1 + L2\ (\sin 2\theta)^n$$

where:

L is a value of said contour offset;

$\theta$ is an angle relative to a coordinate axes of a rolling circle of said cycloidal curve;

$L1 = S_{min}0 \times \frac{1}{2}$, where $S_{min}0$ is a clearance when said rolling circle angle $\theta = 0$ degrees;

$L2 = (S_{min}45 - S_{min}0) \times \frac{1}{2}$, where $S_{min}45$ is the clearance when the rolling circle angle $\theta = 45$ degrees; and n is an exponent.

2. A Roots blower having a plurality of rotors, each of said rotors having a center, an orthogonal short and a long axes and a contour shape offset from a basic profile curve, the improvement in said blower wherein:

said basic profile curve is a combination of epicycloidal curves and hypocycloidal curves, and said shape is defined by a contour curve expressed by equations $$X2 = x - \{L1 + L2(\sin 2\Theta)^n\} \sin \omega$$

$$Y2 = y + \{L1 + L2(\sin 2\Theta)^n\} \cos \omega$$

where:

X2, Y2 are coordinate axes values at a point on the epicycloidal and hypocycloidal curves;

X, Y are coordinate axes values at a point on the epicycloidal and hypocycloidal curves;

$\Theta$ is an angle relative to a coordinate axes of a rolling circle of said cycloidal curve;

$L1 = S_{min}0 \times \frac{1}{2}$, where $S_{min}0$ is a clearance when said rolling circle angle $\Theta 0$ degrees;

$L2 = (S_{min}45 = S_{min}0) \times \frac{1}{2}$, where $S_{min}45$ is the clearance when the rolling circle angle $\Theta = 45$ degrees;

n is an exponent; and $\omega = \tan^{-1}(dy/dx)$, a tangent angle at said point x, y of said coordinate axes.

* * * * *